United States Patent [19]

Spercel

[11] 4,191,086

[45] Mar. 4, 1980

[54] TUNING DEVICE

[76] Inventor: Robert J. Spercel, 3214 West 139th St., Cleveland, Ohio 44111

[21] Appl. No.: 867,164

[22] Filed: Jan. 5, 1978

[51] Int. Cl.[2] ..... G10D 3/14

[52] U.S. Cl. ..... 84/306; 84/312 R

[58] Field of Search ..... 84/200, 204, 304, 305, 84/306, 312

[56] References Cited

U.S. PATENT DOCUMENTS

| | | | |
|---|---|---|---|
| 155,352 | 9/1874 | White | 84/306 |
| 361,500 | 4/1887 | Gardner | 84/306 |
| 2,453,572 | 11/1948 | Ferrier | 84/304 X |
| 2,644,360 | 7/1953 | Smith | 84/312 |
| 2,771,808 | 11/1956 | Jenkins | 84/304 |
| 3,000,253 | 9/1961 | Houde | 84/312 |
| 3,674,909 | 7/1972 | Peters et al. | 84/312 |
| 3,726,172 | 4/1973 | Sorkin | 84/304 |
| 3,830,132 | 8/1974 | Lowe | 84/304 |

FOREIGN PATENT DOCUMENTS 240535 10/1925 United Kingdom .

*Primary Examiner*—Lawrence R. Franklin

[57] ABSTRACT

The present invention provides a new and improved device for adjusting and maintaining the tension in a string of a musical instrument. The string may be tuned to a first pitch by turning a first knob. This actuates a string post through a series of reduction gears to achieve extremely precise tuning of the first pitch. Then the string may be tuned to a second pitch using a second knob. When adjustable stops have been locked in place, the instrument's tuning may be conveniently and repeatably changed from the first pitch to the second pitch and back again. The reduction gearing provides a smaller change in string tension when the first input knob is turned a given amount than when the second knob is turned the same amount. The device is housed in an aluminum housing which is formed from extruded metal bar stock. A pin projects from the housing to secure the device against rotation with respect to the instrument.

26 Claims, 18 Drawing Figures

TUNING DEVICE

BACKGROUND OF THE INVENTION

The invention relates generally to a tuning device for a stringed musical instrument and more particularly to a tuning device capable of tuning a string of the instrument to a first pitch, and of subsequently changing the pitch of the same string to a second pitch, and of repeatably and rapidly changing between the first pitch and the second pitch during the playing of the instrument.

There are known devices for enabling the player of an instrument to change the pitch of a particular string while playing the instrument. Some of these are disclosed in U.S. Pat. Nos. 3,674,909; 3,000,253; 2,771,808; 2,644,360; and 2,453,572. When the effect sought by changing the pitch of a string is a sliding of the pitch away from one note and back again as is done in Hawaiian music, the pitch changing device need only be capable of returning to the first pitch at the end of the slide. But when the effect sought is to change the pitch of a string from a first note to a second note and to play the instrument with the string tuned to the second note, the pitch changing device must be able to quickly and accurately tune to the second note.

SUMMARY OF THE PRESENT INVENTION

The present invention provides a new and improved tuning device for a stringed instrument. The player may vary the tension in a string to select a first pitch by rotating a first knob. This is transmitted through a plurality of reduction gears to a string post to vary the pitch of the string in a well known manner. A second knob varies the pitch of the string from the first selected pitch to a second pitch. The amount of this change is variable, but once adjustable stops have been set, the pitch may be changed back and forth between the two selected pitches.

To achieve precise tuning of the first selected pitch, rotary motion of the first knob is transmitted to the string post through two reduction gear sets connected in series. To achieve rapid change between the first selected pitch and the second selected pitch, rotary motion of the second knob is transmitted to the string post through only the second of the two reduction gear sets. Rotary motion of the first knob is transmitted through a worm and pinion gear set and then through a planetary gear set. Rotary motion of the second knob is transmitted to the string post through only the planetary gear set.

Additionally, the present invention provides a unique method and apparatus to secure the housing against rotation relative to the head of the instrument. A cylindrical pin is permanently attached to and projects from the housing surface which abuts the instrument head. The pin extends into a hole in the head. The pin provides support for the housing against rotation relative to the instrument head.

Additionally, the present invention provides a new method of attaching the string to the string post. The string post has an annular groove with an arcuate bottom surface which receives successive turns of the string. Although a slot or hole may pass along a diameter perpendicular to the axis of the string post, the hole or slot passes obliquely through the string post. The string may be inserted in the lower end of the slot; the free end of the string comes out at the upper end of the slot and is then bent downwards. Succeeding revolutions of the shaft cause the string to naturally bind over the free end of the string, thereby assuring a tight connection between post and string. It should be noted that the slope of the arcuate bottom of the groove in the string post promotes an accumulation of turns of the string in a side-by-side relationship in the groove.

The housing of the present invention is easily made from aluminum on a lathe or similar machine. The aluminum is first extruded into a bar having a cross section of the largest portion of the desired finished housing. The barstock is then mounted in a lathe and portions are cut away. Simultaneous with the cutting of the outside shape, a bit bores the interior cavities. A cut-off tool then separates the housing from the bar stock. The remaining barstock is advanced to repeat the cycle. Finishing operations include boring interior cavities not conveniently bored while the bar stock was rotating in the lathe and anodizing the finished housing.

Accordingly, it is an object of the present invention to provide a new and improved tuning device which is capable of rapidly and repeatably changing between two preset pitches for a string of a musical instrument.

It is a further object of this invention to provide a tuning device as set forth in the preceding object and which has two separate input means for tuning to the two pitches.

It is a further object of this invention to provide a device whereby a string of an instrument may be tuned to a first pitch, then tuned to a second pitch, so that during the playing of the instrument and without noticable interruption in the playing, the string may be changed accurately from one pitch to the other as often as desired.

It is a further object of this invention to provide a new and improved tuning device for a stringed musical instrument as set forth in any one of the next preceding objects and wherein the tuning device has a series of gears including a worm, a pinion gear and planetary gear set to adjust the tension in a string.

It is a further object of this invention to provide a new and improved tuning device for a stringed musical instrument as set forth in any one of the next preceding objects and wherein a planetary gear set enables rapid changing from the first selected pitch to the second selected pitch.

Additionally, it is an object of this invention to provide new and improved method and apparatus to form a housing for a tuning device for a stringed musical instrument.

It is a further object of this invention to provide new and improved tuning device as set forth in any of the preceding objects and having a pin to secure the device against rotation relative to the instrument.

It is an additional object of this invention to provide a new and improved tuning device as set forth in any one of the preceding objects and having a new and improved apparatus for attaching a string to a string shaft including a sloping passage through the shaft through which the string may be passed so that the end portion of the string is easily and naturally turned under succeeding revolutions of the string, thus holding it easily and firmly to the string post.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

General Mode Of Operation

Figure 1:
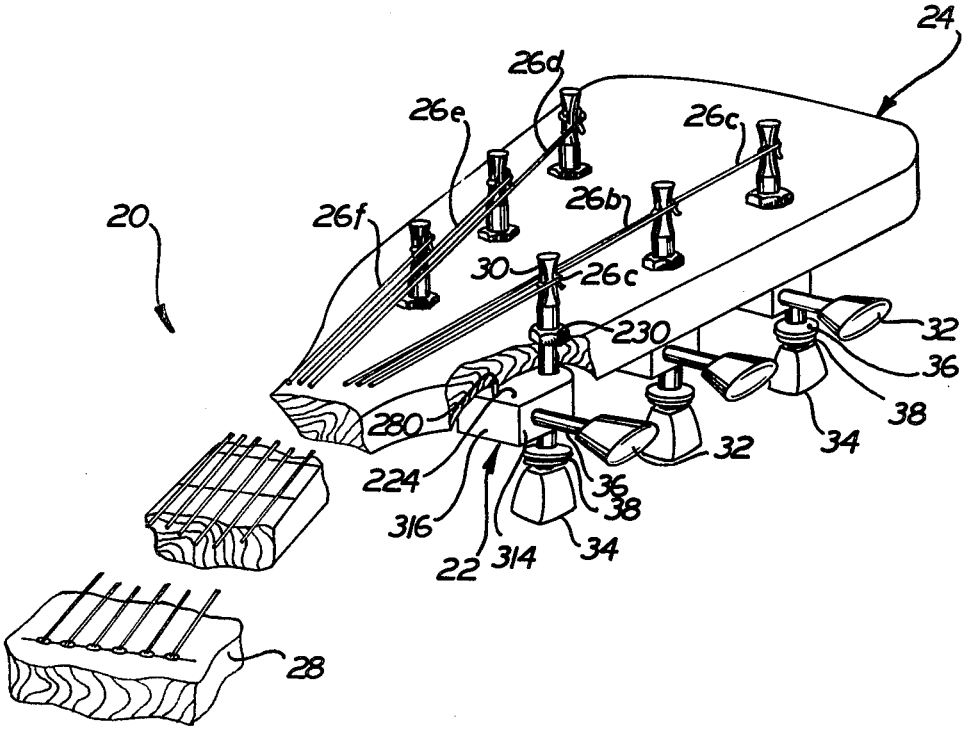
FIG. 1 is a partially broken away pictorial illustration of a stringed musical instrument having tuning devices constructed in accordance with the present invention.

A stringed musical instrument 20, such as a guitar or banjo, has an improved tuning device 22 attached to the head portion 24 (FIG. 1) of the instrument. One end portion of each string 26 is fixedly connected to the instrument at the body 28. The opposite end portion of each string 26 is attached to a tuning device 22 at the head portion 24 of the instrument 20. The tuning device 22 enables the tension in each string 26 to be varied by rotating a post 30 around which it is wound. This varies the pitch of the string 26 in a well known manner.

Figure 2:
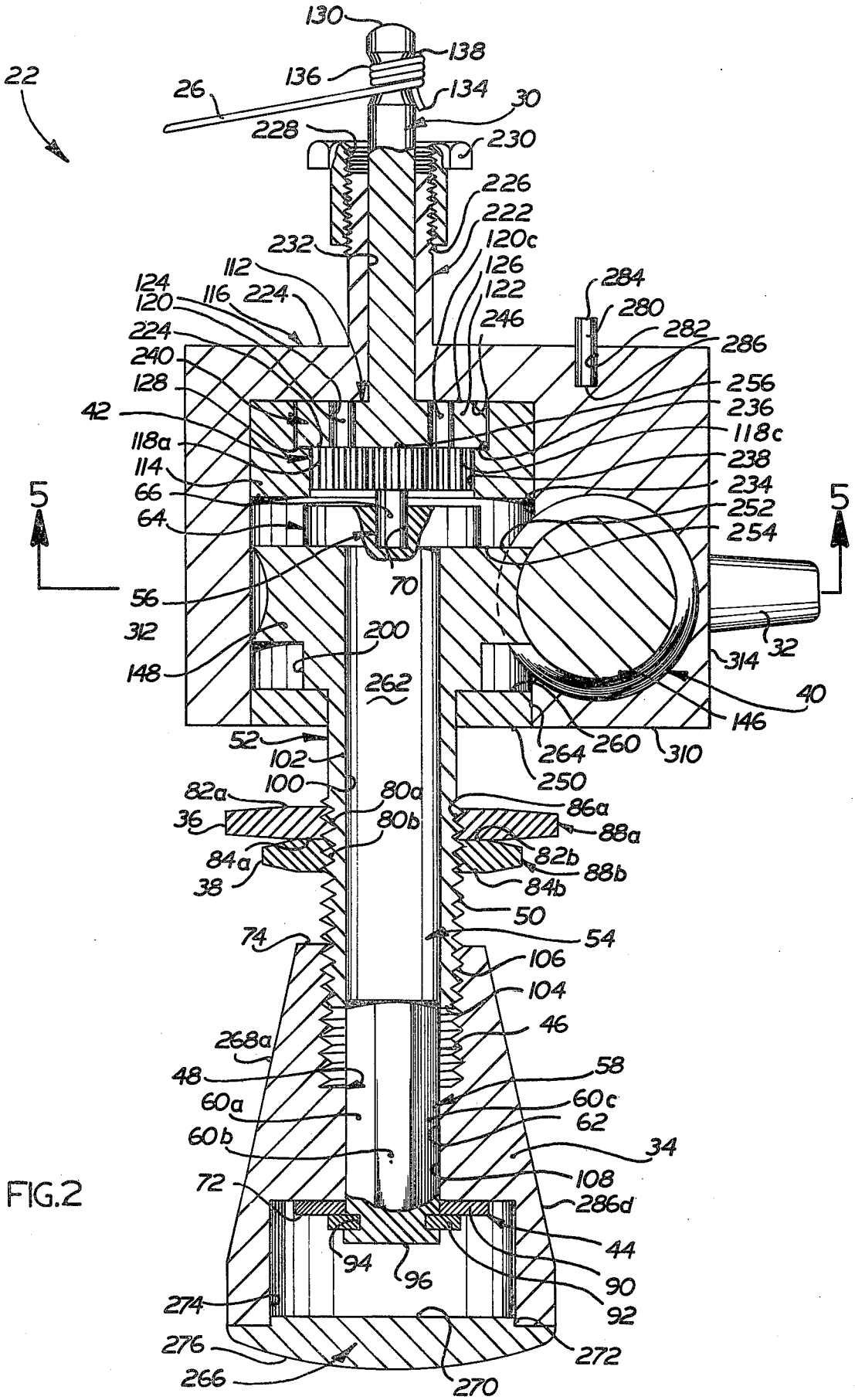
FIG. 2 is an enlarged sectional view of a tuning device of FIG. 1 set to be tuned to a first note.
Figure 3:
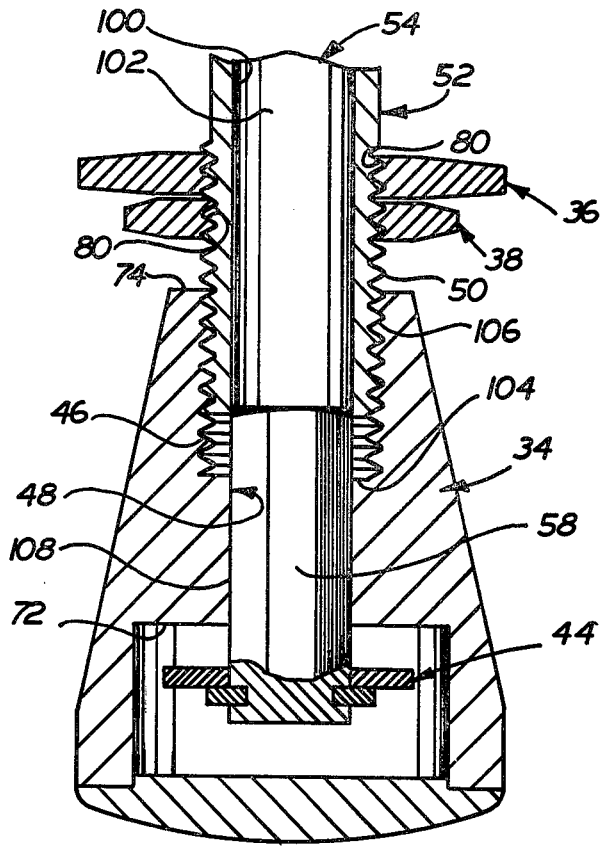
FIG. 3 is a fragmentary view of a portion of the tuning device of FIG. 2 after selection of the second note.
Figure 4:
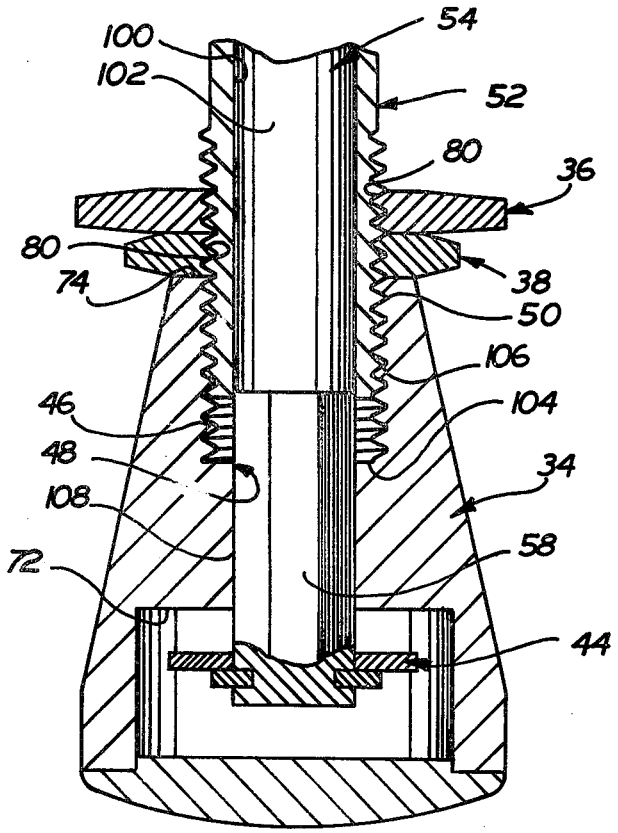
FIG. 4 is a partial fragmentary view, similar to FIG. 3, showing the tuning device after stop nuts have been set to a position corresponding to the second note.

During playing of the stringed musical instrument 20, it may be desirable to change the pitch of a string 26 between two preselected pitches. An improved tuning device 22 constructed in accordance with the present invention enables the string 26 to be tuned to a first pitch by rotating a first input knob 32. The pitch of the string 26 may be varied from a first pitch to a second pitch by turning a second input knob 34 (FIGS. 1, 2 and 3). Stops 36 and 38 are set (FIG. 4) to enable the second knob 34 to be rotated between a position corresponding to the first pitch (FIG. 2) and a position corresponding to the second pitch (FIG. 4).

Figure 7:
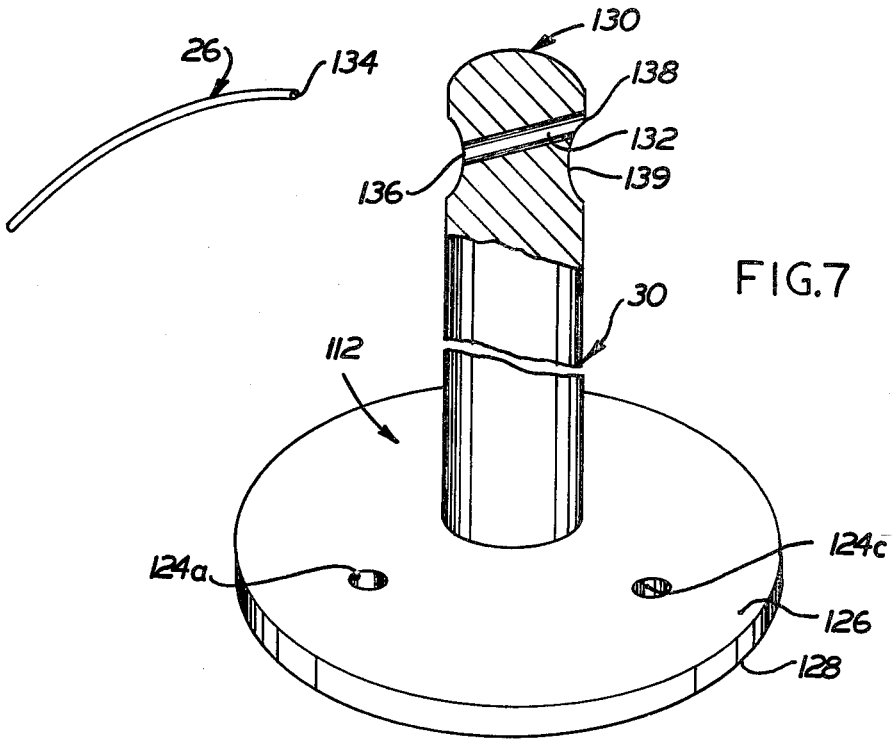
FIG. 7 is a pictorial illustration of the string post of FIG. 2 showing a sloping passage for connecting a string to the post which is connected with a planet carrier of a planetary gear assembly.
Figure 8:
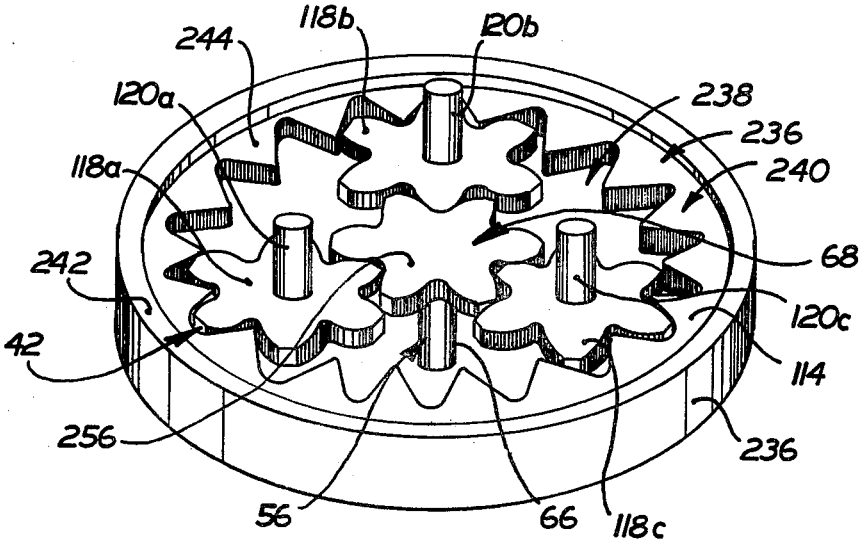
FIG. 8 is a pictorial illustration of planet and sun gears included in the planetary gear assembly of the tuning device of FIG. 2.

A tuning device 22 (FIG. 2) constructed in accordance with the present invention includes two reduction gear sets 40 and 42 connected with the two input knobs 32 and 34. Rotary motion of the first input knob 32 (FIGS. 1 and 2) is transmitted through the first gear set 40 (FIGS. 2 and 5) to the second gear set 42 (FIGS. 2 and 8). The output of the second gear set 42 is connected with the string post 30 (FIGS. 2 and 7). Thus, rotation of the first input knob 32 results in rotation of the string post 30 and a change in the pitch of the attached string 26 to select a first note.

The second input knob 34 (FIGS. 1 and 2) is connected with the input to the second gear set 42 (FIG. 2). Rotary motion of second input knob 34 is transmitted to the string post 30 through only the second reduction gear set 42. Rotation of the second knob 34 causes the post 30 to rotate and thus change the pitch of the string 26 from the first selected pitch to a second pitch.

A fixed limit stop 44 (see FIGS. 2, 3 and 4) and a pair of adjustable limit stops 36 and 38 are used to limit the rotary movement of the second knob 34. When the second knob 34 has been turned from its initial position abutting the fixed limit stop 44 (FIG. 2) to a second position corresponding to the desired second pitch (FIG. 3), the adjustable stops 36 and 38 are rotated to abut the second knob (FIG. 4). This enables the second knob 34 to be turned repeatably between the position corresponding to the first pitch (FIG. 2) and the position corresponding to the second pitch (FIG. 4).

The first knob 32 rotates the string post through two reduction gear sets 40 and 42 linked in series. The large reduction ratio of the combined gear sets 40 and 42 achieves precise control of the position of the post 30 when the string 26 is being tuned to the first pitch through use of the first knob 32.

The second knob 34 actuates the string post 30 through only the second gear set 42. The lower reduction ratio associated with the second gear set 42 operating alone enables rapid changes from the first pitch to a second pitch during playing of the instrument.

To utilize the two-tone tuning feature of the tuning device, the second knob 34 must initially be in abutting engagement with the fixed limit stop 44 (FIG. 2). The first knob 32 may then be turned, and the rotary motion of the first knob is transmitted through the first gear set 40 and the second gear set 42 to the string post 30. With the second knob 34 in abutting engagement with the fixed limit stop 44, rotary motion of the first knob 32 is transmitted to the string post 30 to select the first pitch.

To select the second pitch, the second knob 34 is rotated (FIG. 3). This rotary motion is transmitted to the string post 30 through the second gear set 42 to change the pitch of the string 26 from the first pitch to the second pitch. Because the threads 46 on the inner passage 48 of the second knob 34 cooperate with threads 50 on a tubular member 52 (FIG. 3), rotary movement of the second knob also causes axial movement of the second knob on the tubular member. The rotary movement of the second knob 34 from its initial position corresponding to the first selected pitch (FIG. 2) to the second position corresponding to the second selected pitch (FIG. 3) causes a proportional change in its axial position in the tubular member 52.

The fixed limit stop 44 limits axial motion of the second knob 34 on the tubular member 50 in one direction (downward, as viewed in FIG. 2). The adjustable limit stops 36 and 38 limit axial motion of the second knob 34 in the upward direction. Once the second pitch has been selected, the adjustable limit stops 36 and 38 are set (FIG. 4) against the second knob to prevent any further axial motion of the second knob 34 in the upward direction. The second knob 34 may then be turned between its second position abutting the adjustable limit stops 36 and 38 and its first position abutting the first limit stop 44.

Construction of Tuning Device

A shaft 54 (FIG. 2) transmits rotary motion of the second knob 34 to the input 56 of the second gear set 42. One end portion 58 of the shaft 54 has a hexagonal cross section taken in a plane perpendicular to its longitudinal axis. Abutting engagement of the surfaces 60 of the hexagonal portion 58 of the shaft 60 with the corresponding surfaces 62 in the inner passage 48 of the knob 34 enables rotary motion of the knob to be transmitted to the shaft.

The end portion 64 of the shaft 54 opposite to the hexagonal end portion 58 is fixedly connected and coaxial with the input 56 to the second gear set 42. The input 56 to the second gear set 42 (FIG. 8) includes a cylindrical projection 66 from the input gear 68. The end portion 64 of the shaft 54 includes a cylindrical recess 70 coaxial with the longitudinal axis of the shaft. During assembly, the cylindrical projection 66 from the input or sun gear 68 is pressed into the cylindrical recess 70 in the shaft 54 to establish a fixed, rigid connection between the shaft and the input gear. Thus any rotation imparted to the shaft 54 by the second knob 34 is transmitted to the sun gear 68 of the planetary gear set 42. Rotation of the sun or input gear 68 is transmitted to the string post 30 to vary the pitch of the string 26.

Figure 6:
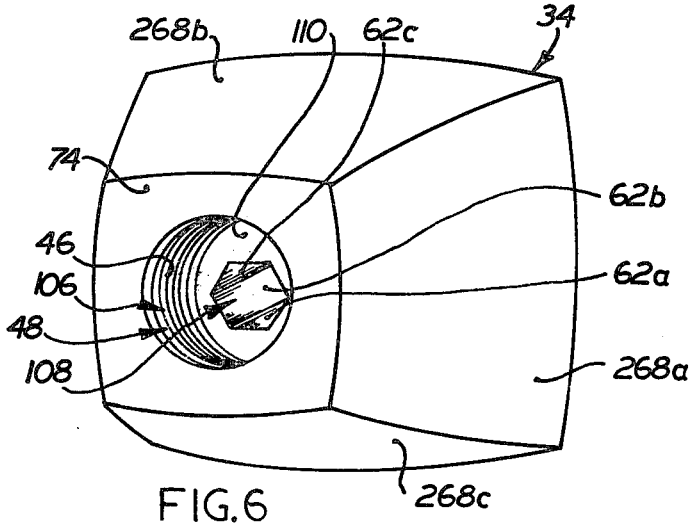
FIG. 6 is a pictorial illustration of a second knob used to change the tension in a string of the musical instrument.

The hexagonal surfaces 62 (FIG. 6) in the second knob 34 enable it to slide on the hexagonal surfaces 60 (FIG. 2) of the shaft 54 while also enabling rotary motion of the knob to be transmitted through the shaft to the input 56 of the second gear set 42. All the surfaces 62 of the hexagonal section of the central passage 48 (FIG. 6) in the second knob 34 are disposed parallel to each other and to the central axis of the passage through the second knob.

Rotary motion of the second knob 34 not only causes the pitch of the string 26 to change, but also causes axial movement of the second knob on the tubular member 52. Engagement of the helical threads 46 in the upper section (as viewed in FIG. 6) of central passage 48 of the second knob 34 with the helical threads 50 on the tubular member 52 causes rotary motion of the second knob to be translated into a proportional axial motion along the tubular member. Because the relationship between the angular position of the second knob 34 and its axial position along the tubular member 52 is fixed by the threads 46 and 50, stops 36, 38 and 44 limiting the axial motion of the second knob also serve to limit its rotary motion.

With the second knob 34 in its initial position (FIG. 2), the fixed limit stop 44 prevents further motion in one axial direction (downward as viewed in FIG. 2). A lower annular stop surface 72 in the knob 34 lies in a plane perpendicular to the central axis of the passage 48 through the knob 34. This stop surface 72 abuts the fixed stop 44 which is fixedly connected with the shaft 54. Because axial motion in the downward direction is prevented, rotary motion in a corresponding direction is prevented as well.

As the second knob 34 is turned to select the second pitch, it moves axially along the tubular member 52 while the hexagonal surfaces 60 and 62 slide with respect to one another. Thus a rotary motion from the second knob 34 is transmitted through the second gear set 42 to the string post 30 through the hexagonal surfaces 60 and 62 as the second knob undergoes a proportional axial motion along the tubular member 52.

When the second desired pitch has been obtained, there is an axial space between the lower stop surface 72 in the knob 34 and the fixed limit stop 44 on the shaft 54 (FIG. 3). The axial magnitude of this space is exactly the distance the second knob moved up the tubular member 52 to obtain the second pitch and is proportional to the change from the first pitch to the second pitch. The adjustable stops 36 and 38 are then screwed down to abut the upper stop surface 74. The second knob 34 may then be rotated between a position where the upper stop surface 74 abuts the adjustable limit stops 36 and 38 and a position where the lower stop surface 72 abuts the fixed limit stop 44, the two positions corresponding to the second and first selected pitches.

The adjustable stops 36 and 38 are effective to be locked in a fixed axial position on the tubular member 52. Each stop 36 and 38 has a generally cylindrical shape with a central threaded passage 80 extending between the two annular surfaces 82 and 84. The threads 86 on the stops 36 and 38 cooperate with the threads 50 on the tubular member 52 in a well known manner to enable each stop to be screwed up or down on the tubular member. When the second pitch has been selected, the first adjustable stop 38 is screwed down the tubular member 52 into abutting engagement with the upper stop surface 74 on the second knob 34 (FIG. 4). The second adjustable stop 36 is then screwed down until it is in firm abutting engagement with the first adjustable stop 36. The knurled outside edges 88 of the stops 36 and 38 facilitate turning one adjustable stop 36 firmly against the other 38, thus locking the stops in a fixed axial position on the tubular member 52.

The fixed limit stop 44 comprises an annular flat washer 90 whose inside diameter circumscribes the hexagonal portion 58 of the shaft 54. The washer 90 is held against axial movement in one direction, (downward as viewed in FIG. 2) relative to the shaft 54 by a snap ring 92 which engages an annular groove 94 proximate one end 96 of the shaft 54.

The coaxial disposition of the shaft 54 and the tubular member 52 enables the second knob 34 to engage both. The shaft 54 is rotatably supported by and partially disposed within the tubular member 52. The cylindrical inside surface 100 of the tubular member 52 abuts the cylindrical central portion 102 of the shaft 54 thus enabling relative rotation of the shaft and tubular member about a common central axis. The external threads 50 on the tubular member 52 extend down to the lower end 104 (as viewed in FIG. 2) of the tubular member. The hexagonal end portion 58 of the shaft 54 extends beyond the end 104 of the tubular member 52.

The second knob 34 is formed to simultaneously engage both the tubular member 52 and the hexagonal end 58 of shaft 54. A stepped central passage 48 connects the upper stop surface 74 (FIG. 2) of the second knob with the lower stop surface 72. The upper, threaded section 106 (FIG. 6) of this passage 48 has a larger diameter than a diagonal through the hexagonal lower portion 108. The two sections 106 and 108 are connected by an annular surface 110. This stepped configuration enables the threaded portion 106 of the passage 108 to engage the threads on the tubular member 52 at the same time that the hexagonal portion 108 engages the shaft 54. Relative rotation of the second knob 34 and the tubular member 52 causes the knob to move axially along the tubular member and to slide axially on the hexagonal section of the shaft 58.

The second gear set 42 (FIGS. 2 and 8) is a differential gear assembly of the planetary type and includes a planetary gear set driven through the sun or input gear 68. Rotation of the shaft 54 causes a rotation of the input gear 68. The output is taken through the carrier assembly 112 (FIG. 7). The ring gear 114 (FIG. 8) is nonrotatably connected with the housing 116 (FIG. 2). Therefore, rotation of the shaft 54 causes a smaller proportional rotation of the carrier 112 in a well known manner.

The carrier 112 is driven by the planet gears 118 (FIG. 8). Each planet gear 118*a*, 118*b* and 118*c* includes a cylindrical projecting member 120*a*, 120*b* and 120*c* coaxial with the axis of revolution of the gear. The carrier 112 includes a cylindrical plate 122 having three cylindrical passages 124*a*, 124*b* and 124*c* equidistant from one another and connecting the upper circular major side surface 126 (as viewed in FIGS. 2 and 7) with the lower circular major side surface 128. The passages 124 cooperate with the cylindrical projections 120 to transmit the angular motion of the center of each gear 118 about the central axis of the sun gear 68 to the carrier 112.

The carrier 112 also includes the generally cylindrical string post 30 (FIG. 7) which is coaxial with the plate 122 and fixedly connected with it. The upper end portion 130 of the post 30 includes a sloping passage 132 to facilitate the connection of a string 26 with the post. The longitudinal axis of the passage 132 lies in a plane that also includes the longitudinal axis of post 30. The intersection of the longitudinal axis of the passage 132 with the longitudinal axis of the post 30 forms an oblique angle. In one preferred embodiment the angle is approximately 75°.

To bind the string 26 (FIG. 2) to the post 30 the free end 134 of the string is inserted into the lower (as viewed in FIG. 7) end 136 of the passage and pulled out the upper end 138. The free end 134 of the string then is folded downward against the post 30. As the post 30 is rotated the free end 134 of the string 26 is naturally bound under succeeding turns of the string. This serves to easily bind the string 26 to the post 30.

The upper end portion 130 of the post 30 includes a circumferential groove 133 having an arcuate bottom surface. The upper end 138 of the passage 132 opens at the upper most edge of this groove 133 (as viewed in FIG. 7). The slope of the arcuate bottom of the groove 133 in the string post 30 promotes an accumulation of turns of the string in a side by side relationship in the groove.

The first gear set 40 (FIGS. 2 and 5) includes a worm 146 and pinion gear 148. The worm gear 146 is rotatably supported in the housing 116 by two cylindrical bearing surfaces 150 and 152 which cooperate with the cylindrical bearing surfaces 154 and 156 at opposite end portions of the worm. The worm 146 is supported against axial motion in one direction by a cylindrical flange 158 connected with one end of the worm. An annular surface 160 on the flange 158 abuts a cooperating annular surface 162 on the housing 116 to prevent axial motion in one direction. Axial motion in the other direction is prevented by the cooperation of an annular surface 164 on a collar 166 with a cooperating annular surface 168 on the housing 116. An input rod 170 (FIG. 5) is integrally formed with the worm 146.

Figure 5:
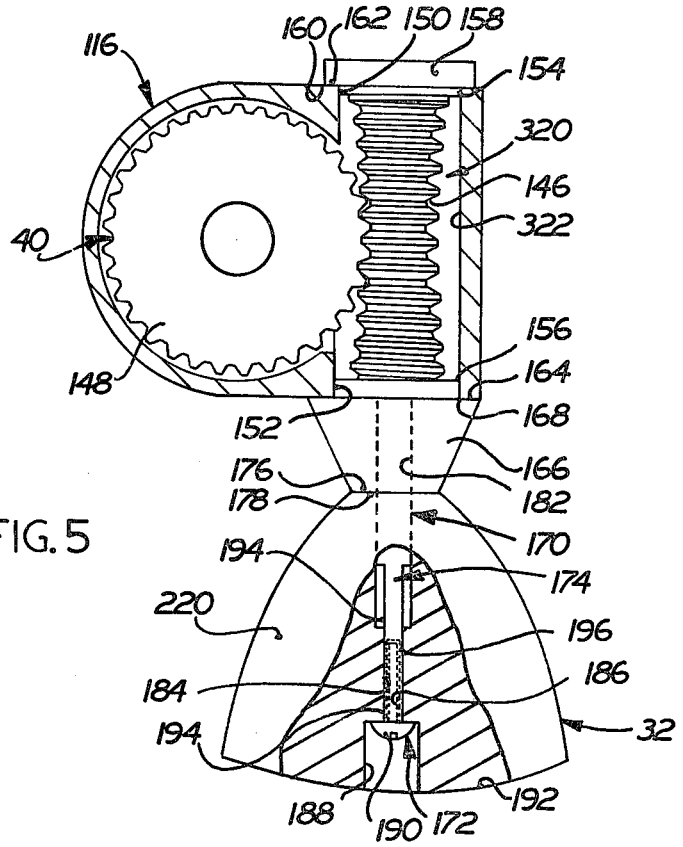
FIG. 5 is a fragmentary view taken along line 5–5 of FIG. 2 illustrating a worm, pinion gear, and first knob for use in adjusting the tension in a string of the musical instrument of FIG. 1.

The first knob 32 is fastened to the input rod 170 by means of a machine screw 172 (FIG. 5). The helical threads (not shown) on the machine screw 172 cooperate in a well known manner with similar helical threads on the inside of a central passage 174 in the rod 170. As the screw 172 is tightened the knob 32 is drawn down the rod until an annular end surface 176 on the knob abuts the annular end surface 178 of the collar 166. As the screw is tightened further, the engagement of surfaces 164 and 168 and of surfaces 176 and 178 limits axial motion of the worm in a second direction.

The collar 166 is generally shaped as a frustrum of a cone with annular end surface 164 having a larger diameter than annular end surface 178. A central passage 182 is coaxial with the axis of symmetry of the collar 166.

The worm 146 is disposed in meshing engagement with the pinion gear 148. Rotary motion of the knob 32 is transmitted through two flats 184 and 186 on the inside of the central passage through the knob 174. The central passage 174 in the knob 32 has two sections, a first cylindrical section 188 that allows the head 190 of the screw 172 to be recessed below the surface 192 of the knob. The second section 194 has two rectangular flats 184 and 186 which are parallel to the major axis of the rod 170 and the first cylindrical section 188. These flats 184 and 186 cooperate with corresponding flats 194 and 196 on the rod 170 to prevent relative rotation of the knob with respect to the rod.

Rotary motion of the knob 32 (FIG. 2) is transmitted through the worm 146 and pinion gear 148 to the tubular member 52. The tubular member 52 is fixedly connected with an annular bearing seat 200. The annular bearing seat 200 is integrally formed with the pinion gear 148. The axis of rotation of the pinion gear 148 is coincident with the longitudinal axis of the tubular member 52 and with the central axis of the sun gear 68.

A cylindrical passage 100 extends through the tubular member 52, the cylindrical bearing seat 200 and the pinion gear 148. The passage 100 in the tubular member 52 rotatably supports the shaft 54 and enables relative rotation between the shaft and the tubular member.

Rotary motion of the first knob 32 in one direction is transmitted to shaft 54 (FIG. 2) when the lower stop surface 72 of the second knob 34 abuts the fixed limit stop 44. When the first knob 32 is rotated, the tubular member 52 also rotates. The engagement of the threads 50 on the tubular member 52 with the threads 46 in the passage 48 of the second knob 34 causes the knob to move axially along the tubular member if it (the second knob) is held against rotation. If the rotation of the tubular member 52 is counterclockwise (as viewed from the top of FIG. 2 or as viewed in FIG. 5), the motion of the knob 34 will be downward (as viewed in FIG. 2), i.e. the threads 50 on the tubular member are right hand threads. When the lower stop surface 72 abuts the fixed limit stop 44, further downward motion is impossible, and the second knob 34 must rotate as the tubular member 52 rotates. Rotary motion of the second knob, as described above, is transmitted through the cooperating hexagonal surfaces 60 and 62 to the shaft 54. Thus, when tuning to the first note, rotary motion of the tubular member 52 is transmitted through the second knob 34 to the shaft 54 and ultimately to the post 30.

Assembly of the Tuning Device

The first step in assembling a tuning device 22 constructed in accordance with the present invention is to insert the worm 146 (FIGS. 2 and 5) into the housing 116 until the annular surface 162 on the housing abuts the corresponding surface 160 on the worm. The collar 166 and the first knob 32 are next installed and held in place by the machine screw 172. The first knob 32 is of a well known configuration and has exterior surfaces 200 adapted to facilitate manual rotation of the knob.

The housing 116 (FIGS. 2, 10 and 15) has a cylindrical section 222 which projects from a generally U-shaped major side surface 224. There are helical threads 226 in the outside of the cylindrical section 222 which cooperate with the threads 228 on a nut 230. In combination they serve to secure the housing 116 to the instrument 20. The cylindrical inside surface 232 of the section 222 rotatably supports the carrier assembly 112 against sidewise motion.

The ring gear 114 and the housing 116 cooperate to hold the carrier 112 in place. (FIGS. 2, 7 and 8). After the carrier 112 is inserted in the cylindrical section 222 of the housing 116, the ring gear 114 is pressed into a cylindrical chamber 234 which is coaxial with the cylindrical section. Tight abutting engagement between the uniform, cylindrical outside surface 236 of the ring gear 114 and the cylindrical chamber 234 prevents any further axial motion of the ring gear.

The ring gear 114 includes an inner passage with upper and lower portions 236 and 238. The upper portion 236 forms a cylindrical recess 240 in the top 242 of the ring gear. This recess 240 has a diameter larger than the diameter of the plate 122 of the carrier 112. When the ring gear 114 has been pressed into place in the housing 116 the annular surface 244 which connects the recess 240 in the upper portion 236 of the ring gear with the lower portion 238 of the ring gear prevents axial motion of the carrier 112 in one direction. The abutting engagement of the top 126 (as viewed in FIGS. 2 and 7) of the plate 122 of the carrier 112 with the annular surface 246 in the housing 116 prevents axial motion of the carrier in the opposite direction.

Once the ring gear 116 has been pressed in place, the remaining parts of the planetary gear set 42 may be installed. The planet gears 118 are placed in meshing engagement with the ring gear 114, and their cylindrical projections 120 are inserted in the passages 124 in the carrier 112. The cylindrical projection 166 from the sun gear 68 is pressed into the passage 70 in the shaft 54, and then the sun gear is inserted into the second gear set 42 to meshingly engage the planet gears 118.

The assembly of the two gear sets 40 and 42 is complete when the pinion gear 148 and the cap 250 have been installed. The pinion gear 148 and attached tubular member 52 are slid over shaft 54 until the annular top surface 252 (as viewed in FIG. 2) of the pinion gear abuts the bottom annular surface 254 of a flanged end portion 64 of the shaft 54. The shaft 54 is held against upward axial motion by the abutting engagment of the generally circular top surface 256 of the sun gear with the bottom 122 of the carrier plate 122. The flanged end portion 64 of the shaft 54 thus prevents further upward axial motion of the pinion gear.

The pinion gear 140 is held against downward axial motion (as viewed in FIG. 2) by an annular cap 250 pressed into the housing 116. The top surface 260 of the cap 250 abuts the bottom surface 262 of an annular member 200 which connects the tubular member 52 with the pinion gear 148. The tight abutting engagement between the cylindrical outside surface 264 of the cap 250 and the cylindrical chamber wall 234 prevents any further axial motion of the cap. Thus the cap 250 serves to retain the two gear sets 40 and 42 in the housing 116.

The final step of assembly of the tuning device 22 include installing the adjustable stops 36 and 38 and fixed 44 stops, the second knob 34 and a cap 266 on the second knob. The two stops 36 and 38 are installed on the tubular member 52 by engaging the threads 50 on the tubular member and rotating the stops.

The exterior of the second knob 34 (FIGS. 2 and 6) may have any desired shape to facilitate manual manipulation of the knob. It is preferred to make the knob 34 shaped generally like the frustrum of a four sided pyramid. The central passage 48 through the knob 34 follows an axis connecting the center of the square bottom of the pyramid with the center of the square top of the pyramid. The four sloping sides 268 of the knob 34 thus serve as gripping surfaces to aid in rotation of the knob.

The second knob 34 is installed on the tubular member 52 just as the adjustable stops 36 and 38 were, by engaging the threads 50 and 46 and rotating the knob. When the knob 34 is in place, the fixed limit stop 44 can be put in place. The annular washer 90 must first be placed around the hexagonal portion 58 of the shaft 54 and in abutting engagement with the lower stop surface 73 on the knob 34. The snap ring 92 may then be placed in engagement with the annular groove 94 circumscribing the hexagonal end portion 58 of the shaft 54. The snap ring 92 cooperates with the groove 94 in a well known manner to prevent axial motion of the washer 94 in one direction.

A cap 266 is used to close the lower end (as viewed in FIG. 2) of the passage 48 through the knob 34. A cylindrical projection 270 forms one major side of the cap. The side surface 272 of the cylinder 270 firmly abuts the cylindrical walls 274 of the passage 48 through the knob 34. This holds the cap 266 in place. The other major side surface 276 of the cap is curved to form a pleasing appearance by blending with the sides 268 of the knob 34.

Assembly is complete when a cylindrical pin 280 (FIG. 2) has been inserted into a closed cylindrical passage 282 in the housing 116. The pin 280 extends from the same surface 224 as the cylindrical section 222 of the housing 116 and cooperates with it to hold the device 22 (FIG. 1) against rotation relative to the head 24 of the instrument 20. The passage 282 extends into the housing 116 perpendicular to the same U-shaped major side surface 224 from which the cylindrial section 222 projects. The pin has two circular end surfaces 284 and 286 disposed generally parallel to each other and twice as far apart as the passage 282 is deep. Thus about one half the length of the pin 280 is exposed and able to be received in a closed cylindrical passage (not shown) in the head 24 of the instrument 20 (FIG. 1). When the pin 280 is properly enclosed by the passage 282 and a corresponding passage (not shown) in the head of the instrument, it serves to hold the tuning device 22 against rotation relative to the head 24 of the instrument 20.

Figure 9:
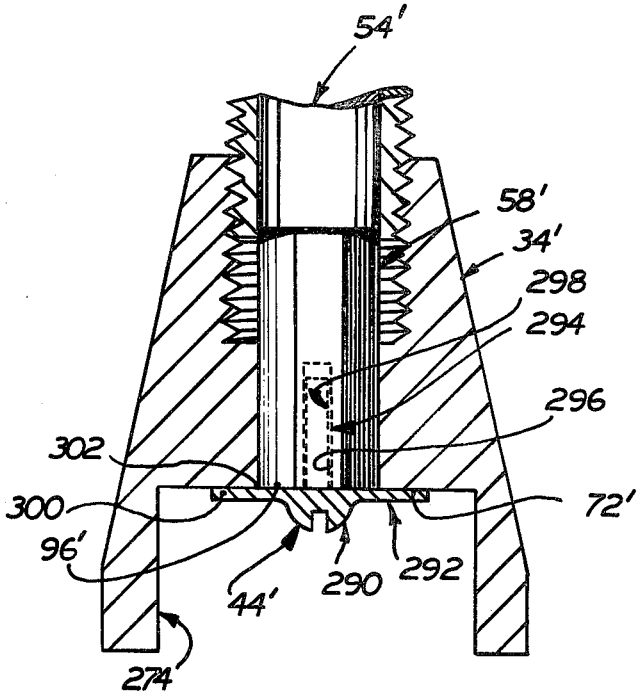
FIG. 9 is a fragmentary illustration of a second embodiment of the knob of FIGS. 2 and 6 and associated stops.

A second embodiment of the present invention is shown in FIG. 9 in which similar numerals are used to indicate similar parts. In this embodiment no cap is used to close the end of passage 274 through the knob 34*a*. Further, the fixed limit stop comprises a machine screw 290 with an enlarged head portion 292. This configuration enables the tuning device 22 (FIG. 2) to be tuned rapidly after removal of the fixed limit stop 44*a* and the knob 34*a*. The shaft 54*a* may now be rotated as many turns as desired without being limited by either the adjustable limits stops 34 and 38 or the fixed limit stop 44*a*.

The machine screw 290 serves as a fixed limit stop. The helical threads 294 on the machine screw 290 cooperate with the helical threads 296 on a cylindrical passage 298 opening into the end 96*a* of the shaft 54*a*. The machine screw 290 is turned into the passage 298 until firm abutting engagement of the head 292 of the screw 290 with the annular end of the shaft 96*a* prevents further axial motion. The enlarged head portion 292 of the machine screw 290 provides a flange 300 which extends beyond the edge 302 of the hexagonal end portion 58*a* of the shaft 54*a*. When the second knob 34*a* is in the first limit condition, the lower stop surface 72*a* abuts the flange 300 of the machine screw 290. Thus, the machine screw 290 prevents further axial motion of the second knob 34 in one direction.

Manufacture of Components

Figure 10:
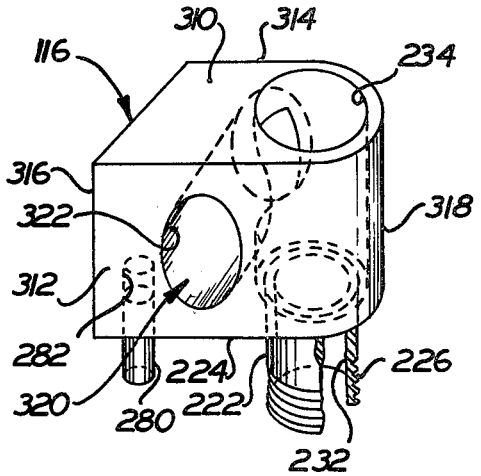
FIG. 10 is a partially broken away view of a housing for the tuning device.
Figure 15:
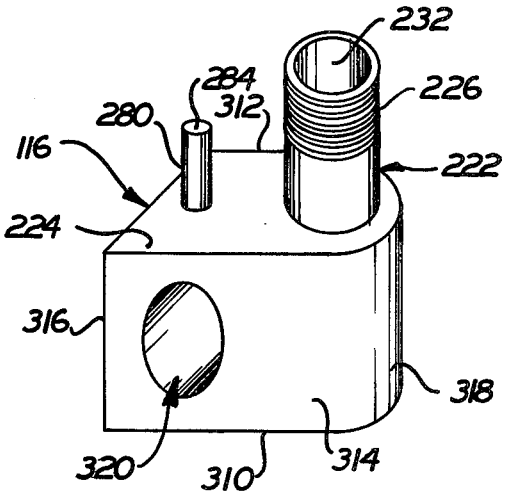
FIG. 15 is a pictorial illustration showing a second view of the housing of FIG. 10.

The housing 116 is formed to conveniently contain the first and second gear sets 40 and 42 and to support the post 30 (FIGS. 1, 10, and 15). The housing 116 has two generally parallel U-shaped major side surfaces 224 and 310 interconnected by two side surfaces 312 and 314 and two end surfaces 316 and 318. The cylindrical passage 320 whose sidewall 322 provides the annular bearing surfaces 150 and 152 FIG. 5) to support the worm 146 extends between and perpendicular to the two side surfaces 314 and 312 of the housing 116 (FIGS. 5, 10 and 15) and parallel to the U-shaped surfaces. The cylindrical chamber 234 (FIGS. 2 and 10) which houses the pinion gear 148 and the planetary gear set 42 extends into the housing 116 perpendicular to one U-shaped surface 310. The cylindrical section 222 extends outward from, and perpendicular to the opposite U-shaped surface 224. The cylindrical section 222, the passage 232 through it, and the cylindrical chamber 234 are all coaxial with the axis of revolution of the semi-cylindrical end surface 318.

Figure 11:
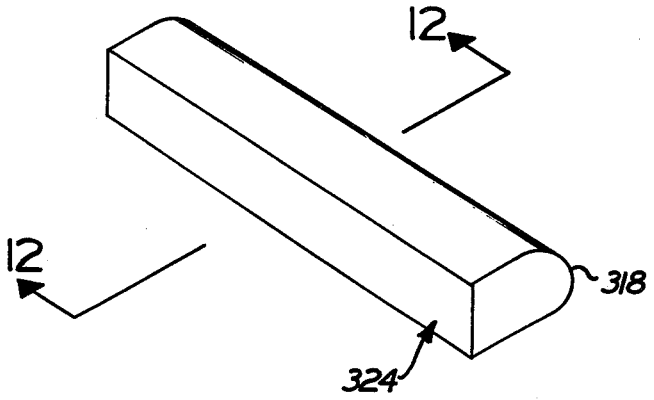
FIG. 11 is a pictorial illustration of a piece of bar stock from which the housing of FIG. 10 is formed.
Figure 12:
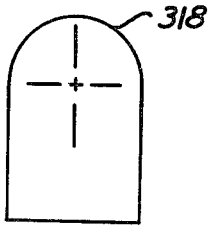
FIG. 12 is a sectional view through the bar stock of FIG. 11 showing the axis of revolution of the curved end portion.
Figure 13:
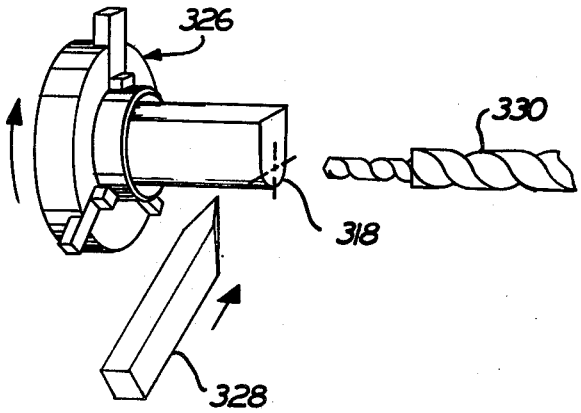
FIG. 13 is a pictorial illustration of the bar stock of FIG. 11 mounted in a lathe in preparation for manufacturing the housing of FIG. 10.
Figure 14:
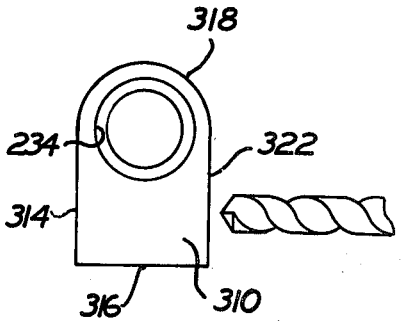
FIG. 14 is a pictorial illustration of the bar stock of FIG. 13 after it has been removed from the lathe and showing a drill for forming a cavity in the housing.

The housing 116 is manufactured from aluminum bar stock 324 (FIG. 11) extruded to have the same cross section as the U-shaped major side surfaces 224 and 310 (FIGS. 10 and 15) of the housing (FIG. 12). The bar stock 324 is mounted in a lathe 326 (FIG. 13) with the axis of rotation coincident with the axis of revolution of the semi-cylindrical end surface 318 of the housing 116. Thus, when the cutting tool 328 cuts away material from the revolving bar stock 324, the resulting cylindrical section 222 and threads 226 are naturally coaxial with the axis of revolution of the semi-cylindrical end surface 318. Likewise, when the stepped bit 330 bores into the revolving bar stock 324 to cut the cylindrical chamber 234 and the cylindrical inside surface 232 of the housing section 222 (FIGS. 2 and 10), the chamber and the cylindrical surface are naturally coaxial with the axis of revolution of the semi-cylindrical end surface 318. The coaxial arrangement of the cylindrical section 222, the passage 232 and the cylindrical chamber 234 allows the components located in each to be connected with each other and to rotate without binding. After removal from the lathe 326 the housing is finished by boring the passage 320 (FIGS. 10 and 14) to support the worm 146 (FIG. 5) and the passage 282 to support the pin 280 (FIG. 10).

It is contemplated by the present invention that a cylindrical hole the same diameter as the cylindrical inside surface 232 could be provided in the bar stock prior to forming the chamber 234. Also contemplated is a method of manufacture in which the cylindrical inside surface 232 and the chamber 234 are cut after the outside shape of the housing has been formed. It is preferred, however, to use a stepped cutting tool 330 and to bore both the cylindrical surface 232 and the chamber 234 at the same time that the cutting tool 328 is forming the exterior of the housing 116.

Figure 16:
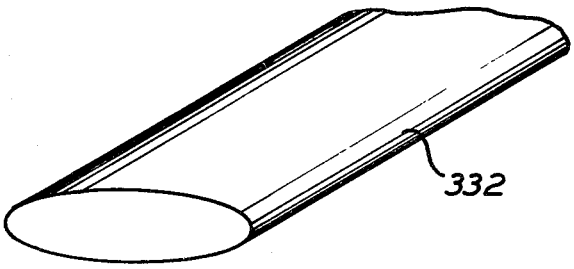
FIG. 16 is a pictorial illustration of a piece of bar stock from which the knob of FIG. 5 is formed.
Figure 17:
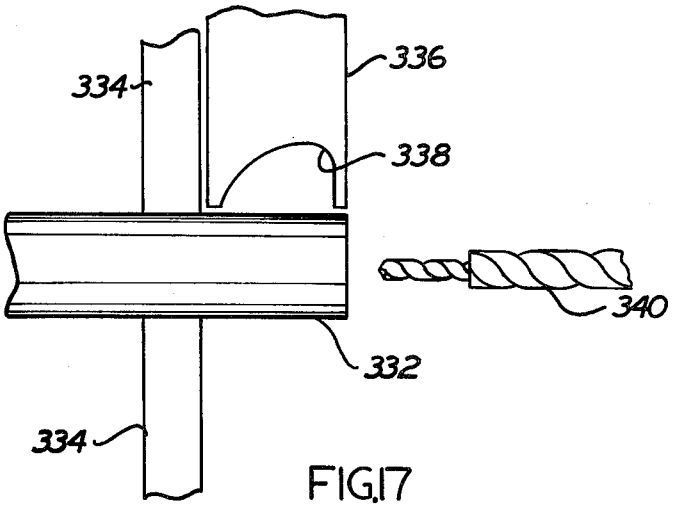
FIG. 17 is a pictorial illustration of the piece of bar stock of FIG. 16 shown mounted in the chuck of a lathe and also showing a cutting tool and bit for forming the knob from the bar stock as it rotates.
Figure 18:
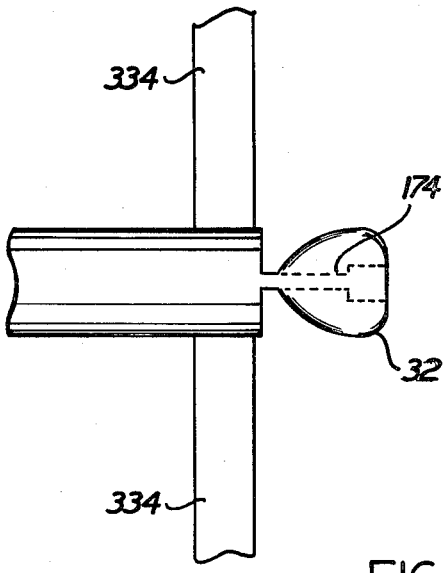
FIG. 18 is a view of the barstock of FIG. 17 after the knob has been formed but before complete separation from the remaining bar stock.

The first knob 32 (FIG. 5) may be conveniently manufactured in a variety of shapes. Aluminum stock is first extruded through dies to form a bar 332 having the desired cross section (FIG. 16.). This bar stock 332 is then mounted in a lathe 334 (FIG. 17) so as to rotate about its central axis. A cutting tool 336 having a cutting edge 338 shaped to cut a knob of the desired profile is used at the same time that a stepped cutting tool 340 approaches axially and bores a cylindrical passage 174 along the central axis of the bar stock 332. After the knob 32 is formed (FIG. 18), it is removed from the remaining bar stock and a broach (not shown) is used to form the flats 184 and 186 (FIG. 5) in a well known manner.

Thus, it is clear that the present invention provides a new and improved tuning device 22 (FIG. 1) for a stringed instrument 20. The player may vary the tension in a string 26 to select a first pitch by rotating a first knob 32. This is transmitted to a plurality of reduction gears 40 and 42 (FIG. 2) to a string post 30 to vary the pitch of the string 26 in a well known manner. A second knob 34 varies the pitch of the string 26 from the first selected pitch to a second pitch. The amount of this change is variable, but once adjustable stops 36 and 38 have been set, the pitch may be changed back and forth between the two selected pitches.

To achieve precise tuning of the first selected pitch, rotary motion of the first knob 32 is transmitted to the string post 30 through two reduction gear sets 40 and 42 connected in series. To achieve rapid change between the first selected pitch and the second selected pitch rotary motion of the second knob 34 is transmitted to the string post 30 through only the second 42 of two reduction gears sets 40 and 42. Rotary motion of the first knob 32 is transmitted through a worm 146 and pinion gear 148 set and second through a planetary gear set 42. Rotary motion of the second knob 34 is transmitted to the string post 30 through only the planetary gear set 42.

Additionally, the present invention provides a unique method and apparatus to secure the housing 116 (FIG. 1) against rotation relative to the head 24 of the instrument 20. A cylindrical pin 280 projects from the housing surface 224 which abuts the instrument head 24. The pin 280 extends into a hole (not shown) in the head 24 of the instrument 20. The pin 280 provides support for the housing against rotation relative to the instrument head 24.

Additionally, the present invention provides a new method of attaching a string 26 to the string post 30 (FIG. 7). The string post 30 has an annular groove or recess 139 with an arcuate bottom surface which receives successive turns of the string 26. Although a slot or hole 132 may pass along a diameter perpendicular to the axis of the string post 30, the hole or slot 132 passes obliquely through the string post. A string 26 may be inserted into the lower end 136 of the slot 132; the free end 134 of the string comes out the higher end 138 of the slot 132 and is then bent downwards. Succeeding revolutions of the shaft 30 naturally bind the free end 134, thereby assuring a tight connection between post 30 and string 26. It should be noted that the slope of the arcuate bottom of the groove 139 in the string post 30 promotes an accumulation of turns of the string 26 in a side by side relationship in the groove (FIG. 2).

The housing 116 (FIGS. 10 through 15) is easily made from aluminum on a lathe 326 or similar machine. The aluminum is first extruded into a bar 324 having a cross section of a largest portion of the desired finished housing 116. The bar stock 324 is then mounted in a lathe 326 and portions are cut away. Simultaneous with the cutting of the outside shape, a bit 330 bores interior cavities 234 and 232. A cutting off tool (not shown) then separates the housing 116 from the bar stock 324. The remaining bar stock 324 is advanced to repeat the cycle. Finishing operations include boring interior cavities 320 and 282 not conveniently bored while the bar stock was rotating in the lathe. The housing 116 may be anodized to any of a variety of colors if desired.

What is claimed is:

1. A device for tuning a string of a musical instrument to a first pitch and to a second pitch and for easily and repeatably changing between the two pitches, said device comprising a post having first and second end portions, said first end portion being adapted to be connected with the string, drive means for rotating said post, first input means connected with said drive means and rotatable about a first axis to cause said drive means to rotate said post to adjust the tension in the string to a tension corresponding to the first pitch, second input means connected with said drive means and rotatable about a second axis to cause said drive means to rotate said post to adjust the tension in the string from the tension corresponding to the first pitch to a tension corresponding to the second pitch, and adjustable stop means for limiting the extent to which said second input means is operable to adjust the tension in the string to limit the change in tension to a change between the tension corresponding to the first pitch and the tension corresponding to the second pitch.

2. A device as set forth in claim 1 wherein at least a portion of said second input means is rotatable and movable axially relative to said post to effect rotary movement of said post through a distance which is proportional to the extent of axial movement of the portion of said second input means, said stop means including means for limiting the axial movement of the portion of said input means to thereby limit the rotary movement of said post.

3. A device as set forth in claim 1 wherein said drive means includes a rotatable shaft having a longitudinal central axis which is disposed in a coaxial relationship with said second axis and means for connecting said shaft with said post to effect rotation of said post about said second axis upon rotation of said shaft, said second input means including a knob which is disposed on said shaft and is manually rotatable about said second axis, said shaft having surface means for enabling said knob to slide axially along said shaft and for cooperating with said knob to transmit rotary motion from said knob to said shaft to rotate said post when said knob is in any one of a plurality of axial positions relative to said shaft.

4. A device as set forth in claim 1 wherein said second input means includes a manually rotatable knob, said stop means including first and second stop members and means for effecting axial movement of said knob between a first position engaging said first stop member and a second position engaging said second stop member upon rotation of said knob.

5. A device as set forth in claim 4 wherein said means for effecting axial movement of said knob upon rotation of said knob includes threads connected with said stop members and said knob.

6. A device as set forth in claim 1 wherein said drive means includes a rotatable shaft and means for connecting said shaft with said post to effect rotation of said post upon rotation of said shaft, said second input means including a knob which is disposed on said shaft and is manually rotatable, said shaft having surface means for enabling said knob to slide axially along said shaft and for cooperating with said knob to transmit rotary motion from said knob to said shaft to thereby rotate said post upon rotation of said knob, said stop means including means for effecting movement of said knob along said shaft upon rotation of said knob and means for limiting the extent of axial movement of said knob along said shaft to thereby limit the extent of rotation of said shaft by said knob.

7. A device as set forth in claim 1 wherein said drive means includes a planetary gear set connected with said post, said planetary gear set including a sun gear, a ring gear and a plurality of planet gears disposed in meshing engagement with said sun and ring gears, said drive means further including a pinion gear operatively connected with said post through said planetary gear set and a worm disposed in meshing engagement with said pinion, said first input means including means for effecting rotation of said worm, said second input means including means for effecting rotation of one of said gears of said planetary gear set.

8. A device as set forth in claim 7 wherein said post is connected with at least a first one of said gears in said planetary gear set and wherein said pinion gear is operatively connected with a second one of said gears in said planetary gear set.

9. A device as set forth in claim 7 wherein said second input means includes a manually rotatable knob, said drive means including a shaft connected with said knob and said sun gear, said device further including a tubular member disposed coaxial with and surrounding said shaft, said tubular member being connected with said pinion gear for rotation therewith upon rotation of said worm, said stop means including external thread convolutions disposed on said tubular member, said knob having internal thread convolutions cooperating with said external thread convolutions to cause axial motion of said knob on said tubular member upon rotation of said knob, said stop means including means for limiting the axial motion of said knob on said tubular member to thereby limit the extent of rotation of said knob.

10. A device as set forth in claim 1 wherein said drive means includes a worm and pinion gear disposed in meshing engagement with said worm, said first input means being effective to rotate said worm to effect rotation of said post, said drive means further including a planetary gear set including a sun gear, a ring gear and a plurality of planet gears disposed in meshing engagement with said sun and ring gears, said second input means being effective to rotate at least one of said gears of said planetary gear set to effect rotation of said post.

11. A device for tuning a string of a stringed musical instrument to a first pitch and to a second pitch and for easily and repeatably changing between the first pitch and the second pitch, said device including a post adapted to be connected with the string, drive means for rotating said post, first manually actuatable means for effecting operation of said drive means to rotate said post to adjust the tension in the string, said first manually actuatable means being movable to a first position corresponding to a first pitch, a second manually actuatable means for effecting operation of said drive means to rotate said post to adjust the tension in the string between the first pitch and a second pitch, said first manually actuatable means remaining in said first position during operation of said second manually actuatable means to adjust the tension in the string between the first and second pitches, and stop means for limiting the extent of actuation of said second manually actuatable means to thereby limit the extent of adjustment of the tension in the string with said first manually actuatable means in said first position.

12. A device as set forth in claim 11 wherein said first manually actuatable means and said second manually actuatable means are rotatable about axes which extend transversely to each other.

13. A device as set forth in claim 11 wherein said drive means includes gear means for transmitting drive forces from said first and second manually actuatable means to said post, said first and second manually actuatable means effecting operation of said gear means to rotate said post.

14. A device as set forth in claim 11 wherein said drive means includes means for holding said first manually actuatable means against movement during movement of said second manually actuatable means.

15. A device as set forth in claim 14 wherein said means for holding said first manually actuatable means includes a worm and pinion gear.

16. A device as set forth in claim 11 wherein said drive means includes a worm and pinion gear, at least one of said first and second manually actuatable means being connected with said worm, said pinion gear being operatively connected with said post to effect rotation of said post upon actuation of said one of said manually actuatable means.

17. A device as set forth in claim 11 wherein said drive means includes a differential gear assembly connected with said post, said first and second manually actuatable means being operatively connected with said differential gear assembly whereby actuation of said first or second manually actuatable means effects rotation of said post.

18. A device for tuning a stringed musical instrument to a first note and for changing from the first note to a second note and for repeatably changing between the first and second notes, said device including a post connected with a string of the instrument, drive means connected with said post for rotating said post, a first rotatable input means connected with said drive means for effecting operation of said drive means to rotate said post through a first arcuate distance upon rotation of said first input means through one revolution, second rotatable input means connected with said drive means for effecting operation of said drive means to rotate said post through a second arcuate distance which is different than said first arcuate distance upon rotation of said second input means through one revolution, and stop means for limiting the extent of rotation of said second input means to thereby limit the magnitude of the arcuate distance through which said post is rotatable by said second input means.

19. A device as set forth in claim 18 wherein said drive means includes a worm, a pinion gear disposed in meshing engagement with said worm, and a planetary gear set connected with said pinion gear, said planetary gear set including a sun gear, a ring gear, and a plurality of planet gears disposed in meshing equipment with said sun and ring gears, said first input means being connected with said worm, said second input means being connected with at least one of said gears in said planetary gear set.

20. A device as set forth in claim 18 wherein said drive means includes a worm and pinion gear disposed in meshing engagement with said worm, said first input means being connected with said worm and being rotatable about a first axis to effect rotation of said worm about said first axis, said drive means further including a planetary gear set including a sun gear, a ring gear, a plurality of planet gears disposed in meshing engagement with said sun and ring gears, said pinion gear being connected with at least a first one of said gears in said planetary gear set, said post being connected with at least a second one of the gears in said planetary gear set to enable rotary motion of said first input means to be transmitted through said worm and pinion gear to said planetary gear set and to said post.

21. A device as set forth in claim 20 wherein said second input means is connected with said first gear of said planetary gear set to enable rotary motion of said second input means to be transmitted through said planetary gear set to said post.

22. A device for tuning a string of a musical instrument, said device comprising a rotatable string post having a first end portion adapted to be connected with the string of the musical instrument, a planetary gear assembly connected with a second end portion of said string post, said planetary gear assembly including a ring gear, as sun gear, a plurality of planet gears disposed in meshing engagement with said ring and sun gears, and a planet carrier connected with said plurality of planet gears, said second end portion of said string post being connected with said planet carrier for rotation therewith relative to said ring gear, a drive shaft connected with said sun gear for rotation therewith, a tubular sleeve member telescopically mounted on said drive shaft, a pinion gear fixedly connected with said tubular sleeve member, a worm disposed in meshing engagement with said pinion gear, a first manually actuatable input knob connected with said worm, and external thread convolution disposed on said tubular sleeve member, a second manually actuatable input knob having an internal thread convolution disposed in engagement with said external thread convolution, said drive shaft having surface means for enabling said second input knob to move axially along said drive shaft and for preventing rotational movement between said second input knob and said drive shaft, first stop means connected with said drive shaft for limiting axial movement of said second input knob in a first direction relative to said drive shaft, and second stop means connected with said tubular sleeve member for limiting axial movement of said second input knob in a second direction relative to said drive shaft.

23. A device for tuning a string of a musical instrument to a first pitch and to a second pitch and for easily and repeatably changing between the two pitches, said device comprising a post having first and second end portions, said first end portion being adapted to be connected with the string, drive means for rotating said post, said drive means including a rotatable shaft and means for connecting said shaft with said post, first input means connected with said drive means for effecting operation of said drive means to rotate said post to adjust the tension in the string to a tension corresponding to the first pitch, second input means connected with said drive means for effecting operation of said drive means to rotate said post to adjust the tension in the string from the tension corresponding to the first pitch to a tension corresponding to the second pitch, said second input means including a knob which is disposed on said shaft and is movable axially along said shaft, and adjustable stop means for limiting the extent to which said second input means is operable in tension to a change between the tension corresponding to the first pitch and the tension corresponding to the second pitch, said stop means including means for effecting movement of said knob along said shaft and means for limiting the extent of movement of said knob along said shaft.

24. A device for tuning a string of a musical instrument and capable of effecting the selection of a first string tension corresponding to a first pitch and capable of repeatably effecting a predetermined change from the first tension to a second tension corresponding to a second pitch, said device comprising in combination a housing attachable to the instrument, a post rotatably supported by said housing, said post having a surface means for enabling one end portion of the string to be attached thereto, a planetary gear assembly disposed within said housing, input means effective to rotate said planetary gear assembly, said planetary gear assembly including a ring gear, a sun gear, a plurality of planet gears disposed in meshing engagement with said sun and ring gears, at least a first one of said gears being connected with said post to effect rotation of said post upon rotation of said input means, a rotatable member connected with at least a second one of said gears and connected with said input means and effective to transmit rotational motion from said input means to said second gear, said input means including first and second knobs, said second knob having threads and being fixed against rotation relative to said rotatable member and axially slidable thereon, a second gear set at least partially disposed within said housing and comprising a worm and coacting pinion gear disposed in meshing engagement with said worm, a threaded tubular member fixedly connected with said pinion gear and having threads which cooperate with the threads on said second knob, a first stop means for limiting axial motion of said second knob on said threaded tubular member in a first axial direction, a second stop means for limiting axial motion of said second knob on said tubular member in a second axial direction, said first knob being connected with said worm to effect rotation of said worm gear and said tubular member, means for transmitting rotational motion of said threaded tubular member through said second knob to said rotatable member, to said planetary gear set, and to said post whenever said first knob is limited in its axial motion by either said first or said second stop means.

25. A device for tuning a string of a musical instrument to a first pitch and then to a second pitch and for changing between the two pitches quickly and repeatably, said device including a rotatable post adapted to be connected with the string, means for rotating said post, said means including a first manually actuatable input for actuating said means to select a first pitch, a second manually actuatable input for actuating said means to select a second pitch, a worm and pinion gear disposed in meshing engagement with said worm, said worm being connected with said first manually actuatable input and rotatable about a first axis, a sun gear, a ring gear, a plurality of planet gears disposed in meshing engagement with said sun and ring gears, said second manually actuatable input being connected with at least one of said sun, ring and planetary gears and rotatable about a second axis, and stop means for limiting the extent of actuation of said second input, said stop means being adjustable to select and maintain a desired interval between said first and second pitches.

26. A device as set forth in claim 25 wherein said post is connected with said planet gears and is rotatable about the axis of rotation of said sun gear upon actuation of said first manually actuatable input and upon actuation of said second manually actuatable input.

* * * * *

UNITED STATES PATENT AND TRADEMARK OFFICE

CERTIFICATE OF CORRECTION

PATENT NO. : 4,191,086

DATED : March 4, 1980

INVENTOR(S) : Robert J. Spercel

It is certified that error appears in the above-identified patent and that said Letters Patent are hereby corrected as shown below:

Column 16, line 19, change "equipment" to --engagement--.

Column 17, line 27, after "operable", insert --to adjust the tension in the string to limit the change--.

Signed and Sealed this

*Twenty-eighth* Day of *October 1980*

[SEAL]

*Attest:*

SIDNEY A. DIAMOND

*Attesting Officer*

*Commissioner of Patents and Trademarks*